US010189246B2

(12) United States Patent
Venner et al.

(10) Patent No.: US 10,189,246 B2
(45) Date of Patent: Jan. 29, 2019

(54) JETTING DEVICE WITH FILTER STATUS DETECTION

(71) Applicant: Océ-Technologies B.V., Venlo (NL)

(72) Inventors: Cornelis W. M. Venner, Venlo (NL); Hylke Veenstra, Venlo (NL); Amol A. Khalate, Venlo (NL); Tjerk E. C. Hummel, Venlo (NL); Marko Mihailovic, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/712,882

(22) Filed: Sep. 22, 2017

(65) Prior Publication Data

US 2018/0009229 A1 Jan. 11, 2018

Related U.S. Application Data

(63) Continuation of application No. PCT/EP2016/056217, filed on Mar. 22, 2016.

(30) Foreign Application Priority Data

Mar. 24, 2015 (EP) ..... 15160565

(51) Int. Cl.
*B41J 2/045* (2006.01)
*B41J 2/175* (2006.01)
(Continued)

(52) U.S. Cl.
CPC ..... *B41J 2/0451* (2013.01); *B41J 2/14233* (2013.01); *B41J 2/17563* (2013.01);
(Continued)

(58) Field of Classification Search
CPC .. B41J 2/0451; B41J 2/17563; B41J 2/14233; B41J 2/16579; B41J 2/2142;
(Continued)

(56) References Cited

U.S. PATENT DOCUMENTS 7,052,117 B2 5/2006 Bibl et al.
9,610,766 B2 * 4/2017 Makita ..... B41J 2/04508

FOREIGN PATENT DOCUMENTS

EP 1 013 453 A2 6/2000
EP 1 378 359 A1 1/2004
(Continued)

OTHER PUBLICATIONS

European Search Report for 15160565, completed on Sep. 16, 2015, is attached herewith.

(Continued)

*Primary Examiner* — Geoffrey S Mruk
(74) *Attorney, Agent, or Firm* — Birch, Stewart, Kolasch & Birch, LLP

(57) ABSTRACT

A jetting device includes an ejection unit arranged to eject a droplet of a liquid. The ejection unit includes a nozzle, a liquid duct connected to the nozzle, and an electro-mechanical transducer arranged to create an acoustic pressure wave in the liquid in the duct. The jetting device further includes a filter arranged to filter the liquid being supplied into the duct and a filter status detection system arranged to detect an obstruction status of the filter by measuring a property of the liquid in the duct. The filter status detection system includes a circuit configured for measuring the electric response of the transducer, for recording changes in the electric response that represent pressure fluctuations induced by the acoustic wave in the form of a time-dependent function, and for judging the obstruction status of the filter on the basis of that function.

19 Claims, 6 Drawing Sheets

(51) Int. Cl.

| | |
|---|---|
| ***B41J 2/14*** | (2006.01) |
| *B41J 2/165* | (2006.01) |
| *B41J 2/21* | (2006.01) |

(52) U.S. Cl.
CPC ..... *B41J 2/16579* (2013.01); *B41J 2/2142* (2013.01); *B41J 2002/1437* (2013.01); *B41J 2002/14354* (2013.01); *B41J 2002/14403* (2013.01)

(58) Field of Classification Search
CPC .... B41J 2002/14403; B41J 2002/14354; B41J 2002/1437
See application file for complete search history.

(56) References Cited

FOREIGN PATENT DOCUMENTS

| | | | |
|---|---|---|---|
| EP | 1 378 360 | A1 | 1/2004 |
| JP | 2012-183730 | A | 9/2012 |

OTHER PUBLICATIONS

International Search Report for PCT/EP2016/056217 (PCT/ISA/210) dated Jul. 4, 2016.
Written Opinion of the International Searching Authority for PCT/EP2016/056217 (PCT/ISA/237) dated Jul. 4, 2016.

* cited by examiner

JETTING DEVICE WITH FILTER STATUS DETECTION

CROSS-REFERENCE TO RELATED APPLICATIONS

This application is a Continuation of PCT International Application No. PCT/EP2016/056217, filed on Mar. 22, 2016. PCT/EP2016/056217 claims priority under 35 U.S.C. § 119 to Application No. 15160565.6, filed in Europe on Mar. 24, 2015. The entirety of each of the above-identified applications is expressly incorporated herein by reference.

BACKGROUND OF THE INVENTION

1. Field of the Invention

The invention relates to a jetting device comprising an ejection unit arranged to eject a droplet of a liquid and comprising a nozzle, a liquid duct connected to the nozzle, and an electro-mechanical transducer arranged to create an acoustic pressure wave in the liquid in the duct. The jetting device further comprises a filter arranged to filter the liquid being supplied into the duct, and a filter status detection system arranged to detect an obstruction status of the filter by measuring a property of the liquid in the duct.

More particularly, the invention relates to an ink jet printer.

2. Background of the Invention

The electro-mechanical transducer may, for example, be a piezoelectric transducer or an actuator of the ejection unit acting as a transducer forming a part of the wall of the duct. When a voltage pulse is applied to the transducer, this will cause a mechanical deformation of the transducer. As a consequence, an acoustic pressure wave is created in the liquid ink in the duct, and when the pressure wave propagates to the nozzle, an ink droplet is expelled from the nozzle.

Typically, the jetting device or print head comprises a large number of ejection units that can be controlled individually and to which the ink is supplied via a common filter. The filter has the purpose of preventing the entry of contaminants into the ejection units. However, in the course of extended operation, the filter may itself become clogged by contaminants, so that the flow of ink is more and more obstructed. When this obstruction reaches a certain level, the ink that is consumed by the nozzles, especially when a plurality of nozzles are fired simultaneously, e.g. when a solid line or area is being printed, cannot be replaced fast enough, resulting in a pressure drop in the ink in the duct. As a consequence, the droplet generation processes may become unstable.

U.S. Pat. No. 7,052,117 B2 discloses a jetting device of the type indicated above, wherein the obstruction status of the filter is monitored by measuring a liquid pressure drop across the filter.

EP 1 378 359 A1 and EP 1 378 360 A1 describe ink jet printers, which comprise an electronic circuit for measuring the electric impedance of the piezoelectric transducer. Since the impedance of the transducer is changed when the body of the transducer is deformed or exposed to an external mechanical strain, the impedance can be used as a measure of the reaction forces which the liquid in the duct exerts upon the transducer. Consequently, the impedance measurement can be used for monitoring the pressure fluctuations in the ink that are caused by the acoustic pressure wave that is being generated or has been generated by the transducer.

The impedance measurement may be performed in the intervals between successive voltage pulses. In that case, the impedance fluctuations are indicative of the acoustic pressure wave that is gradually decaying in the duct after a droplet has been expelled. This information may then be used for adapting the amplitude of the next voltage pulse.

As has been described in EP 1 013 453 A2, the impedance measurement and the monitoring of the pressure wave in the duct may also be utilized for detecting a brake-down of the ink duct without interrupting the operation of the printer. For example, air bubbles in the ink duct will cause a characteristic signature in the decay pattern of the acoustic wave. Similarly, if the duct is (partially) closed by a solid particle, this will result in an impedance signal having a lower frequency, a smaller initial amplitude and a stronger damping characteristic.

SUMMARY OF THE INVENTION

It is an object of invention to provide a jetting device of the type described in the opening paragraph, wherein the filter status detection system has a simplified design.

In order to achieve this object, according to the invention, the filter status detection system comprises a circuit configured for measuring an electric response after actuation of the transducer, for recording changes in the electric response that represent pressure fluctuations induced by the acoustic wave in the form of a time-dependent function P(t), and for judging the obstruction status of the filter on the basis of that function P(t).

Electric response in the context of the present invention may be construed as an electric current, electric voltage, electric impedance and the like (derived quantities).

The inventors have found that, although the filter is normally disposed remote from the part of the ink duct that connects the transducer to the nozzle, the obstruction status of the filter nevertheless has a measurable influence on the behavior of the acoustic pressure waves in the duct, so that the status of the filter may be judged by analyzing the time dependence of the measured pressure fluctuations.

Accordingly, the invention has the advantage that no specific detector is needed for measuring a pressure drop across the filter. When the jetting device is of a type wherein the electric response of the transducer is measured anyway for other purposes, e.g. for feedback-controlling the pulse amplitude, the filter status detection system may largely rely upon the electronic circuitry that is available already for measuring the impedance.

Useful details and preferred embodiments of the invention are indicated in the dependent claims.

Methods of detecting the obstruction status of the filter are claimed in independent method claims.

The status of the filter may be checked from time to time, during a period in which the printer is not operating, e.g. during a start-up period of the printer or during a time when the print head is subject to a maintenance operation. Preferably, all nozzles or at least a large number of nozzles are fired simultaneously for creating a large demand for ink. Then, when the filter is clogged to a certain extent, this will cause a significant pressure drop in the ink duct and consequently a detectable change in the behavior of the acoustic waves.

In an alternative embodiment, the status check may be performed even while the printer is operating. Typically, when the printer is used for printing an image, there will be occasions where a large number of nozzles are fired simultaneously because a solid black line or a solid black area of the image has to be printed. At that time it can be checked by monitoring the electric response of the transducer of at least one ejection unit whether the obstruction status of the filter has caused a pressure drop in the ink duct.

The electric response measurement may be performed either during the time in which a voltage pulse is applied to the transducer or in the interval between subsequent voltage pulses. Since the nozzles are typically arranged at small intervals in order to obtain a high image resolution, there will in many cases be a certain amount of cross-talk among the different ejection units. Consequently, it is also possible to monitor the electric response fluctuations of a transducer that has not been actuated itself, but only senses the pressure fluctuations that have been generated in neighboring nozzles.

In order to create a pressure wave that can be used for analyzing the obstruction status of the filter, it is not even necessary to generate a droplet at all. It is sufficient to apply to the transducer a so-called pre-fire pulse which just causes the ink in the duct to vibrate but has an amplitude that is not sufficient for expelling a droplet. Such pre-fire pulses are frequently applied anyway in order to keep the nozzles clean during the intervals in which no droplets are ejected.

Conceivably, when the clogging of the filter has caused a pressure drop in the ink duct, a voltage pulse with a higher amplitude will be needed for expelling a droplet. The fact that a droplet has actually been expelled is revealed by a characteristic signature in the time function that describes the acoustic wave. Consequently, the filter status can also be checked by varying the amplitude of the voltage pulses and then checking on the basis of the detected wave patterns the smallest voltage amplitude at which a droplet has been ejected.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
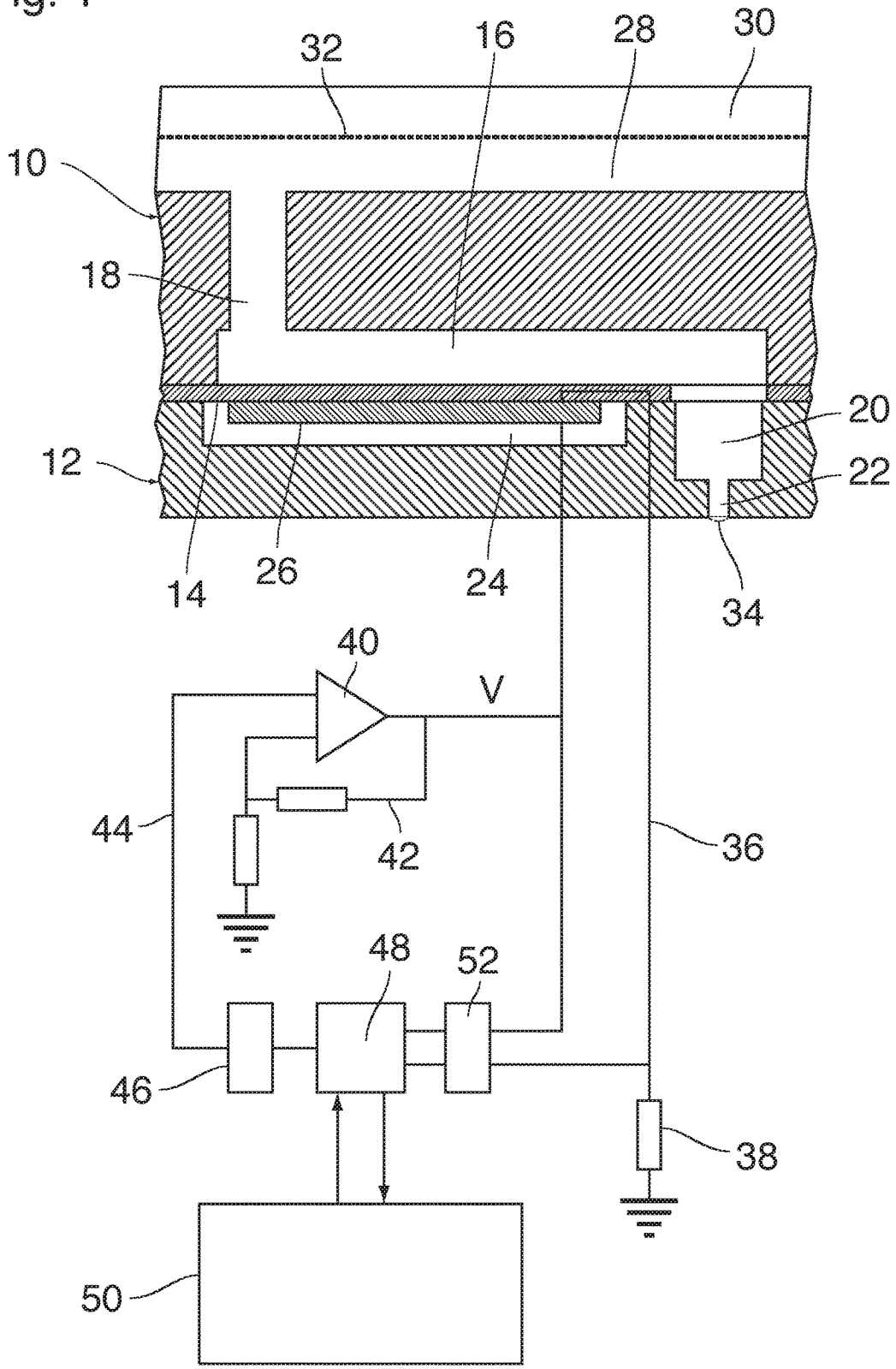
FIG. 1 is a cross-sectional view of mechanical parts of a jetting device according to the invention, together with an electronic circuit for controlling and monitoring the device.

The present invention will now be described with reference to the accompanying drawings, wherein the same or similar elements are identified with the same reference numeral.

A single ejection unit of an ink jet print head has been shown in FIG. 1. The print head constitutes an example of a jetting device according to the invention. The device comprises a wafer 10 and a support member 12 that are bonded to opposite sides of a thin flexible membrane 14.

A recess that forms an ink duct 16 is formed in the face of the wafer 10 that engages the membrane 14, e.g. the bottom face in FIG. 1. The ink duct 16 has an essentially rectangular shape. An end portion on the left side in FIG. 1 is connected to an ink supply line 18 that passes through the wafer 10 in a thickness direction of the wafer and serves for supplying liquid ink to the ink duct 16.

An opposite end of the ink duct 16, on the right side in FIG. 1, is connected, through an opening in the membrane 14, to a chamber 20 that is formed in the support member 12 and opens out into a nozzle 22 that is formed in the bottom face of the support member.

Adjacent to the membrane 14 and separated from the chamber 20, the support member 12 forms another cavity 24 accommodating a piezoelectric actuator 26 that is bonded to the membrane 14.

The ink supply line 18 connects the ink duct 16 to an ink buffer 28 (downstream ink buffer) that is separated from another ink buffer 30 (upstream ink buffer) by a filter 32.

The buffers 28 and 30, the ink supply line 18, the ink duct 16, the chamber 20 and the nozzle 22 are filled with liquid ink. An ink supply system which has not been shown here keeps the pressure of this liquid ink slightly below the atmospheric pressure, e.g. at a relative pressure of −1000 Pa, so as to prevent the ink from leaking out through the nozzle 22. In the nozzle orifice, the liquid ink forms a meniscus 34.

The piezoelectric transducer 26 has electrodes that are connected to an electronic circuit that has been shown in the lower part of FIG. 1. In the example shown, one electrode of the transducer is grounded via a line 36 and a resistor 38. Another electrode of the transducer is connected to an output of an amplifier 40 that is feedback-controlled via a feedback network 42, so that a voltage V applied to the transducer will be proportional to a signal on an input line 44 of the amplifier. The signal on the input line 44 is generated by a D/A-converter 46 that receives a digital input from a local digital controller 48. The controller 48 is connected to a processor 50.

When an ink droplet is to be expelled from the nozzle 22, the processor 50 sends a command to the controller 48 which outputs a digital signal that causes the D/A-converter 46 and the amplifier 40 to apply a voltage pulse to the transducer 26. This voltage pulse causes the transducer to deform in a bending mode. More specifically, the transducer 26 is caused to flex downward, so that the membrane 14 which is bonded to the transducer 26 will also flex downward, thereby to increase the volume of the ink duct 16. As a consequence, additional ink will be sucked-in via the supply line 18. Then, when the voltage pulse falls off again, the membrane 14 will flex back into the original state, so that a positive acoustic pressure wave is generated in the liquid ink in the duct 16.

This pressure wave propagates to the nozzle 22 and causes an ink droplet to be expelled.

The electrodes of the transducer 26 are also connected to an A/D converter 52 which measures a voltage drop across the transducer and also a voltage drop across the resistor 38 and thereby implicitly the current flowing through the transducer. Corresponding digital signals are forwarded to the controller 48 which can derive the impedance of the transducer 26 from these signals. The measured electric response (current, voltage, impedance, etc.) is signaled to the processor 50 where the electric response is processed further, as will be described below.

The acoustic wave that has caused a droplet to be expelled from the nozzle 22 will be reflected (with phase reversal) at the open nozzle and will propagate back into the duct 16. Consequently, even after the droplet has been expelled, a gradually decaying acoustic pressure wave is still present in the duct 16, and the corresponding pressure fluctuations exert a bending stress onto the membrane 14 and the actuator 26. This mechanical strain on the piezoelectric transducer leads to an electric response of the transducer, and this electric response can be measured with the electronic circuit described above. The measured electric response represent the pressure fluctuations of the acoustic wave and can therefore be used to derive a time-dependent function P(t) that describes these pressure fluctuations.

Figure 2A:
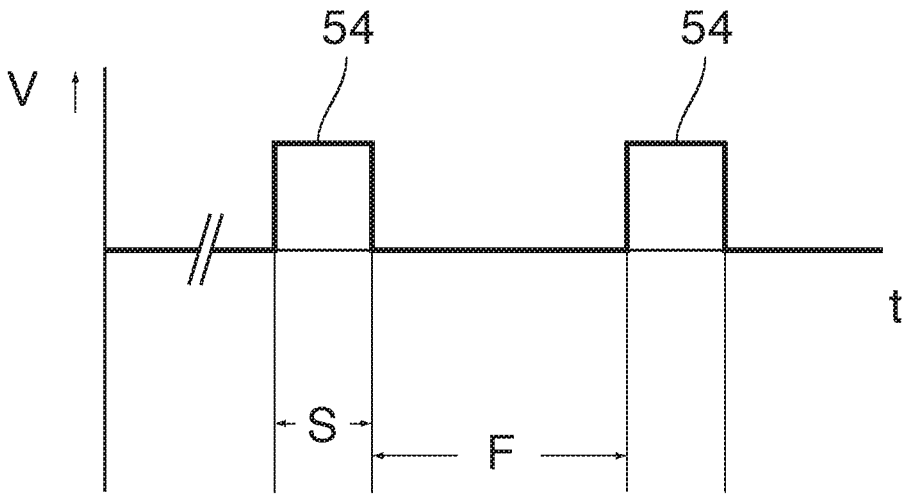
FIG. 2A is a time diagram showing a sequence of voltage pulses to be applied to a transducer of a jetting device.

FIG. 2A shows the voltage V (in arbitrary units) applied to the transducer 26 as a function of the time t.

When rectangular pulses 54 which have the duration S (suction period) are applied to the transducer, the transducer will flex downwardly so that ink is sucked in. The intervals between the pulses 54 have a duration F (firing period) and form the actual activation pulses which create a positive pressure wave for expelling the droplet. The amplitude of the voltage pulses is defined as the difference between the voltage V applied during the suction period S and the voltage applied during the firing period F.

Figure 2B:
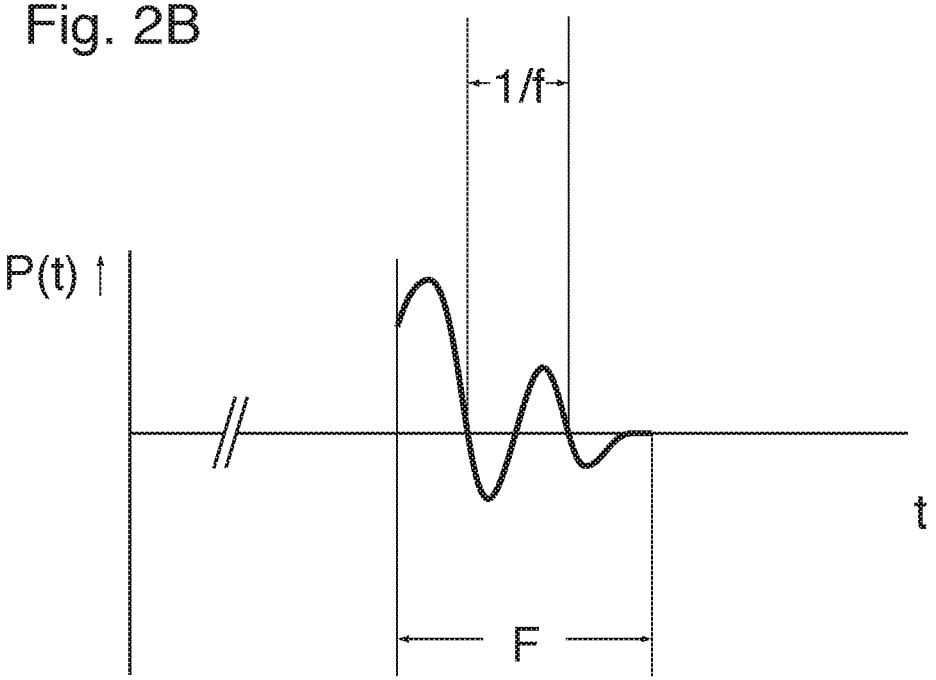
FIG. 2B is a time diagram illustrating an acoustic pressure wave that has been excited by one of the pulses shown in FIG. 2A.

The resulting pressure fluctuations as represented by the function P(t) are shown in FIG. 2B for the firing period F between the pulses 54.

It will be understood that, depending upon the polarization and initial condition of the transducer 26, the voltage applied to the transducer may be non-zero during the firing periods F or during the suction periods S or during both periods.

It is possible to measure the electric response of the transducer during the suction periods S.

The processor 50 records the function P(t) which may then be analyzed further for judging the condition of the filter 32.

Figure 3:
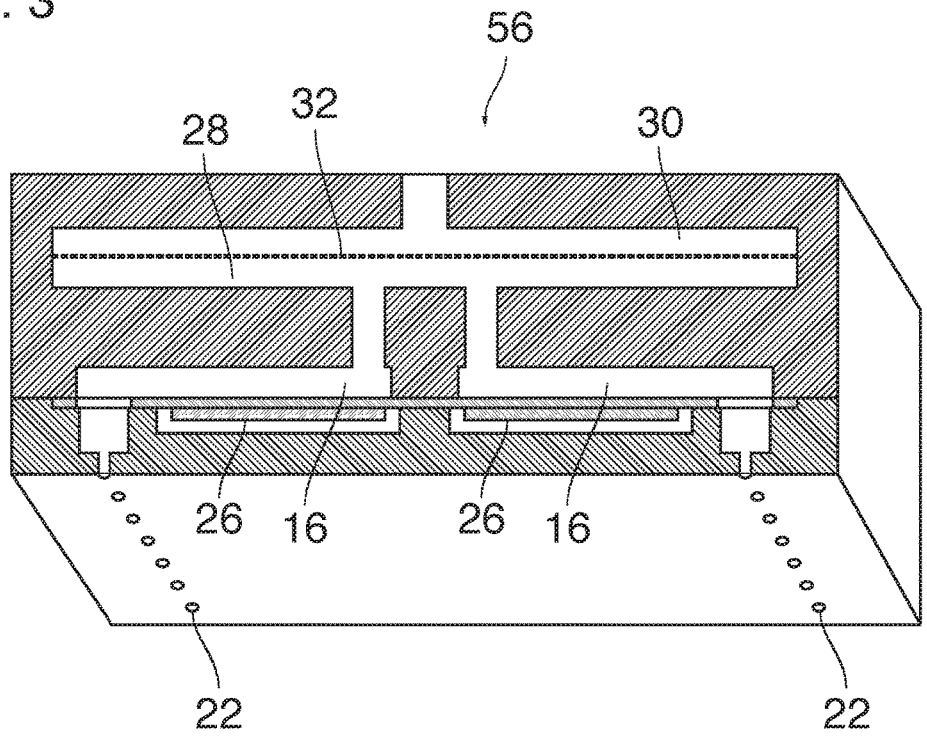
FIG. 3 is a perspective view, partly in cross-section, of a jetting device having a plurality of nozzles.

As is shown in FIG. 3, the entire print head is formed by a micro-electromechanical system (MEMS) that has a plurality of nozzles 22 with their related droplet ejection units which each have their own ink duct 16 and transducer 26. In the non limitative example shown here, the nozzles 22 are arranged in two parallel rows.

The ink buffers 28, 30 and the filter 32, however, are common to a large number of nozzles.

Likewise, the processor 50 may be arranged to control a plurality of transducers 26.

The ink that is to be supplied to the ink ducts 16 of the ejection units has to flow through fine pores of the filter 32. When the ink contains contaminants in the form of solid particles, these may gradually clog the filter, so that, in the course of operation, the filter 32 will increasingly obstruct the flow of ink to the ink ducts. Consequently, when a large number of nozzles 22 have been fired simultaneously and the consumption of ink is correspondingly high, this may cause a pressure drop in the ink duct 16. For example, the pressure may drop from −1000 Pa to −1500 Pa.

Figure 4:
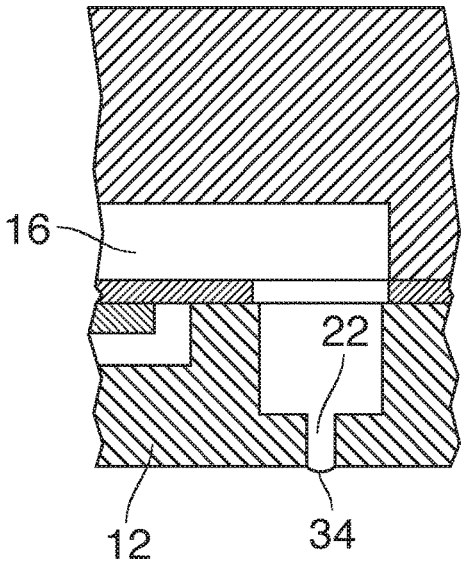
FIGS. 4 and 5 are enlarged cross-sectional views of a part of the jetting device, showing different conditions of a liquid meniscus in the nozzle.
Figure 5:
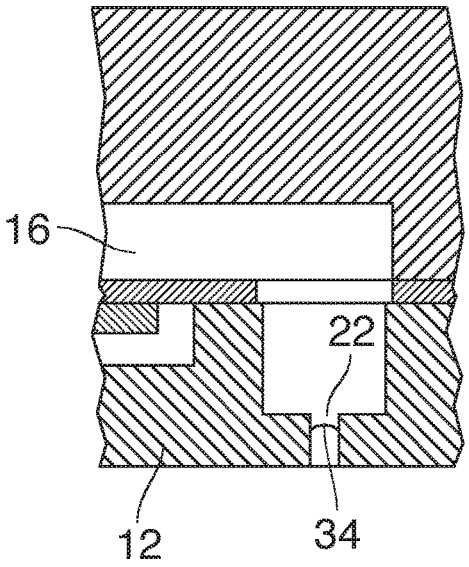

As a result, the ink that is present in the nozzles 22 will be sucked back to some degree, so that the meniscus moves inwardly as has been shown in FIGS. 4 and 5. FIG. 4 shows the normal condition, with a pressure of −1000 Pa in the ink duct 16, and FIG. 5 illustrates the case that the filter 32 is clogged and the pressure has dropped to −1500 Pa. In this example, it is assumed that the bottom a face of the support member 12 which forms the so-called nozzle face has an anti-wetting coating, whereas the internal walls of the nozzles 22 can be wetted by the ink. As a consequence, the meniscus 34 is bulging outwardly in FIG. 4, but when the meniscus is withdrawn into the nozzle, it will bulge inwardly as in FIG. 5.

The pressure drop in the ink duct 16 that has been caused by the filter clogging has an influence on the shape of the function P(t) that has been shown in FIG. 2B and reflects the behavior of the acoustic pressure wave. This effect can be utilized for detecting the pressure drop by analyzing the function P(t).

For example, when the positive pressure wave is generated at the end of the pulse 54, the pressure wave travels to the nozzle 22 where it is reflected at the meniscus 34 and then travels back to the transducer 26. In the case of FIG. 5, the total distance which the wave has to travel is shorter than in FIG. 4, and this has the consequence that the "echo" of the wave is detectable at the transducer 26 somewhat earlier.

Moreover, in practice the function P(t) will not be a pure sine wave, but will include higher harmonics. Especially when a droplet is expelled and a new meniscus is formed in the nozzle orifice, this causes an abrupt pressure change that excites a broad spectrum of higher frequencies. A certain frequency component in the spectrum will resonate in the cavity that is delimited to one part by the walls of the ink duct 16 and to another part by the meniscus 34. The different positions of the meniscus 34 in FIGS. 4 and 5 will therefore result in a "mistuning," i.e. a change of the resonance frequency that can also be analyzed in order to determine the pressure drop in the ink duct.

When the function P(t) is recorded also during the suction period S, i.e. during the pulses 54, a sharp pressure drop will be observed at the start of the pulse 54, and this drop will be significantly more pronounced when the filter 32 is clogged.

All these effects provide criteria that permit to judge the obstruction state of the filter 32 by analyzing the function P(t) that describes the fluctuations in pressure and electric response.

However, the pressure drop in the ink ducts 16 will only be a temporary phenomenon, that occurs immediately after a time where the consumption of ink has been particularly high, i.e. where a large number of nozzles 22 have been fired simultaneously. When the consumption of ink is lower, the filter 32 will permit the ink to flow into the ink ducts, so that the pressure drop will disappear after certain time.

One possibility to create a measurable pressure drop is to fire a sufficient number of nozzles 22 simultaneously. A method for testing the filter status that is based on this principle has been illustrated in FIG. 6.

Figure 6:
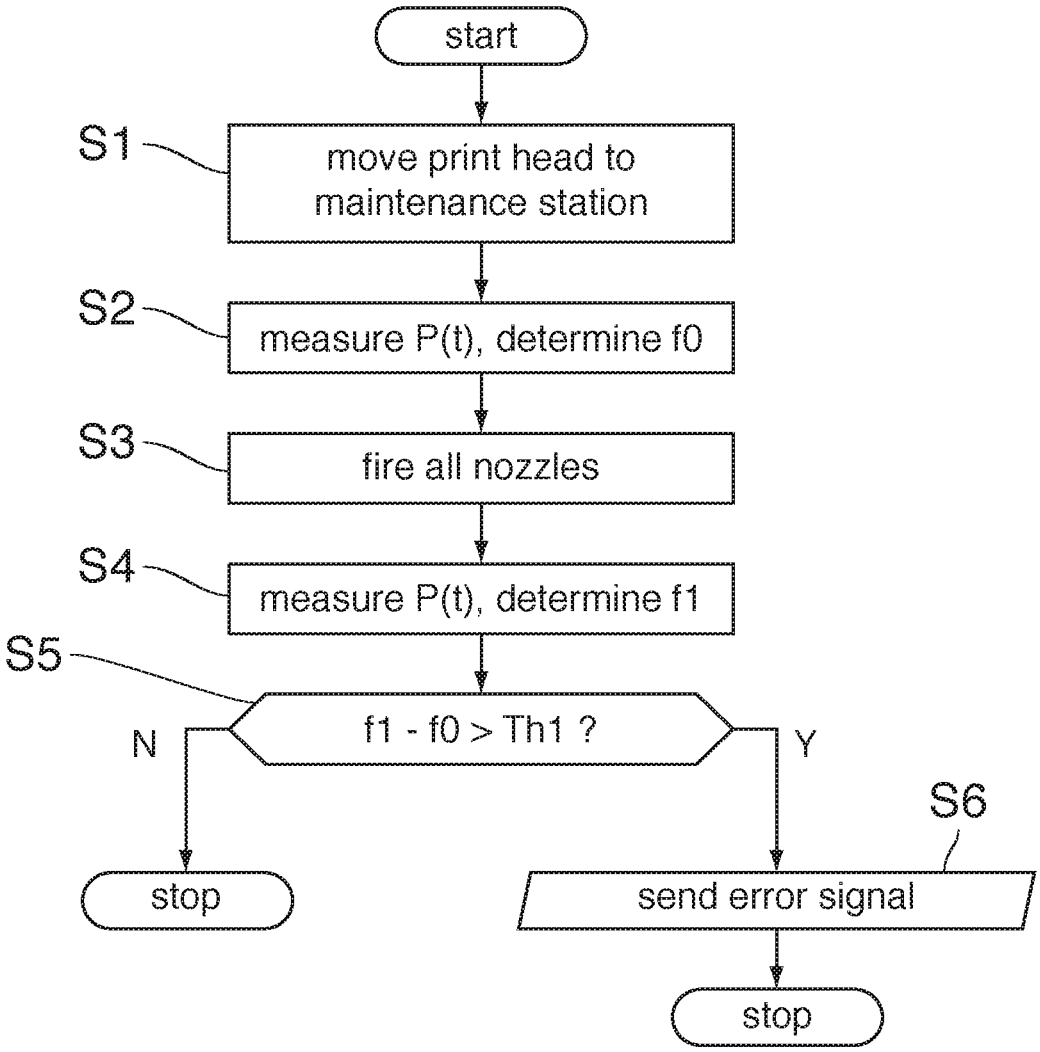
FIGS. 6 to 8 are flow diagrams showing different modes of operation of the jetting device according to the invention.

The test procedure shown in FIG. 6 is performed while the printer is not operating. In step S1, the print head is moved to a maintenance station of the printer which is offset from the print surface that supports a recording medium. Conveniently, the filter test may be performed at the time when the print head is moved to the maintenance station anyway for a maintenance operation in which the nozzles and the nozzles face are cleaned.

When the printer is in the maintenance station, the transducer 26 of at least one ejection unit is activated in step S2 so as to generate an acoustic wave, the corresponding pressure fluctuations as given by the function P(t) are measured and recorded, and the frequency f0 of the oscillation is determined. It should be noted that the frequency of the oscillation is the inverse of the oscillation period 1/f which has been shown in FIG. 2B. The frequency f0 that is determined in step S2 is the oscillation frequency that is obtained when there is no shortage of ink in the ink duct and the pressure is at the nominal value of −1000 Pa.

Then, in step S3, all nozzles 22 (or at least a large number of nozzles) are fired simultaneously in order to create an abrupt increase in the ink demand and, consequently, a pressure drop if the filter is clogged to a substantial degree.

Then, before the pressure has returned to the nominal value, the function P(t) is recorded again in step S4, and the oscillation frequency f1 of that function is determined. The step S4 may be performed immediately after the nozzles have been fired in step S3, still the same firing period F, in order to observe the pressure fluctuations in that period. As an alternative, it is possible to fire at least one or a few nozzles a second time in order to generate a new pressure wave and then to measure the function P(t) for the nozzles. In any case, the oscillation frequency f1 is obtained under a condition where the pressure in the ink ducts should be below the nominal value of −1000 Pa if the filter is clogged.

Then, the frequencies f1 and f0 obtained in steps S4 and S2 are compared to one another, and when their difference is larger than a certain threshold value Th1, this indicates that a pressure drop has actually occurred, and an error signal indicating that the filter is clogged is sent in step S6.

On the other hand, when the frequency difference is smaller than Th1, this means that the pressure drop was not large enough to cause a substantial shift in frequency, and the condition of the filter is still acceptable, whereupon the test procedure is stopped without sending an error signal.

Since the steps S2-S6 are performed while the print head is in the maintenance station, the ink droplets that are ejected in step S3 and possibly again in step S4 will not stain the recording medium but can be collected in the maintenance station. It should be observed however that, in step S4, is not necessary to actually eject ink droplets. In order to excite the pressure fluctuations, it may be sufficient to apply a voltage pulse with a smaller amplitude which is not sufficient for ejecting ink droplets.

The measurement steps S2 and S4 may be performed for all nozzles or only for a few selected nozzles or even only for one nozzle. Since the clogging state of the filter may vary locally, the flow of ink to some of the ink ducts 16 may be more obstructed than the flow to other ink ducts to the same print head. For that reason, it may be useful to perform the measurements for a plurality of nozzles that are distributed over the entire print head.

Figure 7:
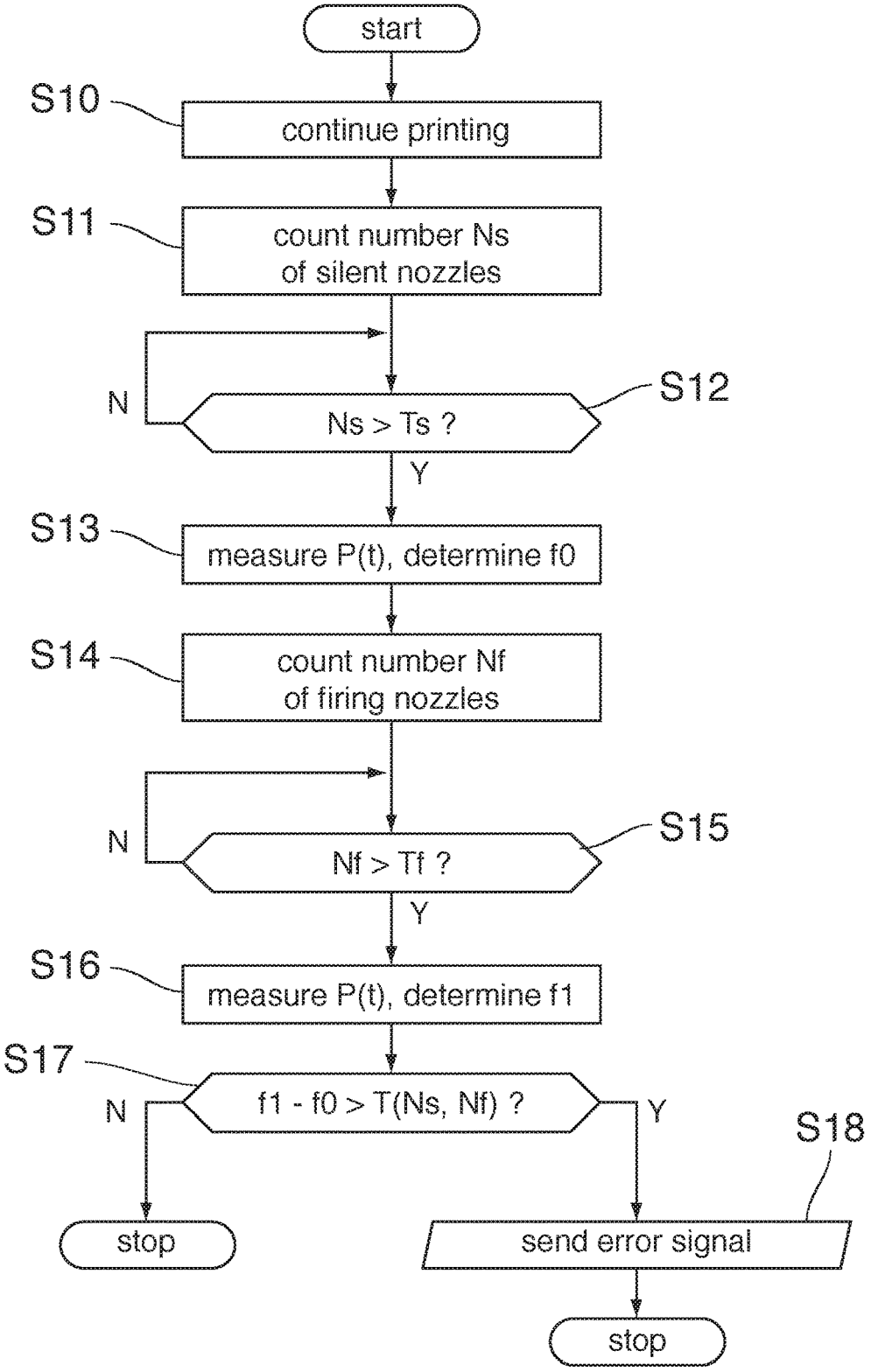

FIG. 7 illustrates an alternative test procedure which may be performed even while the printer is operating. To symbolize this, the flow diagram in FIG. 7 starts with a step S10 "continue printing."

A subsequent step S11 consists of counting a number Ns of silent nozzles, i.e. nozzles that have not been fired during a time interval of a few seconds or milliseconds which is long enough to assure that, even when the filter is heavily clogged, the ink had time enough to flow into the ink ducts 16, so that no pressure drop is to be expected.

Then, it is checked in step S12 whether the counted number Ns is larger than a certain threshold Ts. If this is not the case (N), the step S12 is repeated until the condition is met.

If a sufficient number of nozzles has been silent during the specified time interval (Y), then the function P(t) is recorded for at least one nozzle, and the corresponding oscillation frequency f0 is determined in step S13. Thus, the frequency f0 can be used as a reference value that applies to the case where no pressure drop is present.

Then, when the next image line is being printed, the number Nf of nozzles that are fired simultaneously in order to print on that line is counted in step S14.

In Step S15, it is checked whether the counted member Nf is larger than a threshold value Tf. If that is not the case (N), the step S15 is repeated until the condition is met.

If Nf is larger than the threshold Tf (Y), this means that the consumption of ink has been so high that a pressure drop should be expected if the filter is clogged. Then, the function P(t) is recorded again for at least one nozzle in step S16, and the oscillation frequency f1 of that function is determined.

In step S17, it is checked whether the frequency difference f1−f0 is larger than a threshold value T(Ns,Nf). This threshold value is variable and depends on the counted numbers Ns and Nf. When Ns and Nf are high, this means that only a very small pressure drop if any is to be expected in step S13 but a large pressure drop should be expected in step S15, so that the frequency difference should be large, even when the filter is only moderately clogged. In that case, the threshold value should be relatively high. In contrast, when Ns and Nf are relatively small, the threshold value should be lowered because then even a smaller frequency difference would be indicative of a significantly clogged state of the filter.

Depending upon the result in step S17, the procedure is ended either with sending an error signal in step S18 or without sending an error signal.

Figure 8:
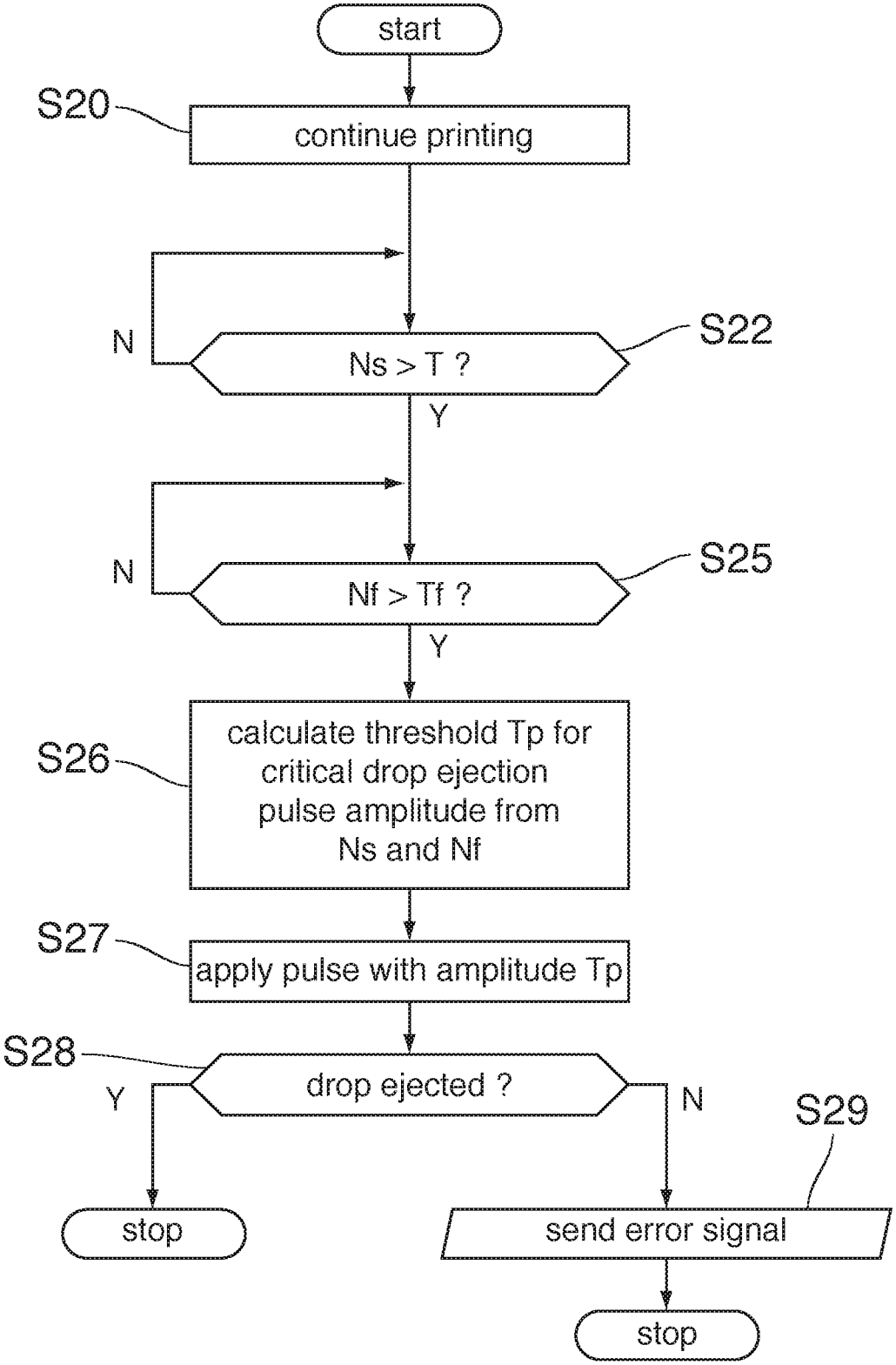

FIG. 8 illustrates another embodiment of the test procedure which may also be performed while the printer is operative. Steps S20, S22 and S25 are equivalent to the steps S10, S12 and S15 in FIG. 7.

In step S26, a threshold value Tp is calculated from the counted numbers Ns and Nf. The threshold value Tp specifies an amplitude of the voltage pulse that is to be applied to the transducer of at least one nozzle. Whether or not a droplet will be ejected from that nozzle will depend upon the height of the voltage pulse and on the pressure drop in the ink duct 16. Assuming that the filter is clogged to an extent that marks the limit between acceptable and non-acceptable, the expected pressure drop (the difference between the pressure at the time when the number Ns was counted in step S22 and the time when the number Nf was counted in step S25) can be calculated from the numbers Ns and Nf. For a given pressure drop, it is known which amplitude of the voltage pulse is needed at a minimum for expelling a droplet. The threshold value Tp is set to the amplitude of the smallest voltage pulse that would be sufficient for ejecting a droplet when the pressure drop is as large as indicated by the numbers Ns and Nf.

Then, a voltage pulse with that amplitude Tp is applied to at least one transducer in step S27, and the pressure fluctuations are monitored.

In step S28 it is decided on the basis of the monitored pressure fluctuations whether or not a droplet has been ejected (e.g. by detecting higher harmonics in the pressure oscillations).

When no droplet has been ejected (N), this means that the pressure drop was too large and the clogging condition of the filter is worse than acceptable. In that case, an error signal is sent in step S29. On the other hand, when a droplet was ejected, this means that the pressure drop was smaller and the filter clogging is still acceptable. In that case the test is ended without sending an error signal.

Preferably, the voltage pulse in step S27 will be applied only to a relatively small number of nozzles so that, even when these nozzles eject droplets, only a very small number of tiny ink dots will be formed on the recording medium, and these dots will be hardly visible so that the image quality is not substantially compromised.

In a modified embodiment, a test based on the same principles as in FIG. 8 may also be performed while the print head is in the maintenance station, which permits to set Ns (=0) and Nf (all nozzles) as desired.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A jetting device comprising:

an ejection unit arranged to eject a droplet of a liquid, said ejection unit comprising:

a nozzle;

a liquid duct connected to the nozzle; and an electro-mechanical transducer arranged to create an acoustic pressure wave in the liquid in the duct;

a filter arranged to filter the liquid being supplied into the duct; and a filter status detection system arranged to detect an obstruction status of the filter by measuring a property of the liquid in the duct, wherein the filter status detection system comprises a circuit configured to measure the electric response of the transducer, to record changes in the electric response that represent pressure fluctuations induced by the acoustic wave in the form of a time-dependent function P(t), and to judge the obstruction status of the filter on the basis of said time-dependent function P(t).

2. The jetting device according to claim 1, wherein the transducer is a piezoelectric transducer.

3. The jetting device according to claim 1, wherein the filter status detection system is configured to measure the electric response of the transducer during a period (F) in which the transducer is energized for causing a droplet to be expelled.

4. The jetting device according to claim 1, wherein the filter status detection system is configured to measure the electric response of the transducer during a period (S) in which the transducer is energized for sucking liquid from the side of the filter into the duct.

5. The jetting device according to claim 1, wherein the filter status detection system is configured to vary the amplitude of a voltage pulse to be applied to the transducer.

6. A method of detecting an obstruction status of a filter in a jetting device, the jetting device comprising an ejection unit arranged to eject droplets of a liquid, the ejection unit comprising a nozzle, a liquid duct connected to the nozzle, and an electro-mechanical transducer arranged to create an acoustic pressure wave in the liquid in the duct, and the jetting device further comprising a circuit configured to measure the electric response of the transducer, said method comprising the steps of:

ejecting droplets from the nozzle in order to create an increased demand for liquid in the duct;

creating an acoustic pressure wave in the duct of the ejection unit by energizing the transducer with or without ejecting another droplet;

recording changes in the electric response of the transducer that represent pressure fluctuations induced by the acoustic pressure wave in the form of a time-dependent function P(t); and judging the obstruction status of the filter on the basis of said time-dependent function P(t).

7. The method according to claim 6, further comprising the steps of:

energizing the transducer with an activation pulse that has a predetermined amplitude (Tp);

recording the change of electric response of that transducer as a function P(t) of time;

analyzing the function P(t) of time to decide whether or not a droplet has been expelled; and judging the obstruction status of the filter on the basis of the amplitude of the activation pulse and the result of the decision.

8. The method according to claim 6, wherein the jetting device is an ink jet print head and the method is performed while the print head is in a maintenance station.

9. The method according to claim 6, wherein the jetting device is an ink jet print head and the method is performed while the print head is operating, and wherein the demand for ink is created by printing on a recording medium.

10. A method of detecting an obstruction status of a filter in a jetting device that comprises a plurality of ejection units, each of the plurality of ejection units being arranged to eject droplets of a liquid and comprising a nozzle, a liquid duct connected to the nozzle, and an electro-mechanical transducer arranged to create an acoustic pressure wave in the liquid in the duct, the jetting device further comprising a circuit configured to measure the electric response of the transducer, said method comprising the steps of:

activating a number of transducers of the ejection units simultaneously for ejecting droplets from the nozzles in order to create an increased demand for liquid in the duct of at least one ejection unit, thereby creating also an acoustic pressure wave in the duct of said at least one ejection unit;

recording changes in the electric response of the transducer that represent pressure fluctuations induced by the acoustic pressure wave in the form of a time-dependent function P(t); and judging the obstruction status of the filter on the basis of said time-dependent function P(t).

11. The method according to claim 10, further comprising the step of:

activating the transducer of said at least one ejection unit by another activation pulse in order to create an acoustic pressure wave in the duct of said at least one ejection unit.

12. The method according to claim 11, wherein said activation pulse has an amplitude that is sufficient for creating the pressure wave, but not sufficient for ejecting a droplet.

13. The method according to claim 11, further comprising the steps of:

energizing the transducer with an activation pulse that has a predetermined amplitude (Tp);

recording the change of electric response of that transducer as a function P(t) of time;

analyzing the function P(t) of time to decide whether or not a droplet has been expelled; and judging the obstruction status of the filter on the basis of the amplitude of the activation pulse and the result of the decision.

14. The method according to claim 11, wherein the jetting device is an ink jet print head and the method is performed while the print head is in a maintenance station.

15. The method according to claim 11, wherein the jetting device is an ink jet print head and the method is performed while the print head is operating, and wherein the demand for ink is created by printing on a recording medium.

16. The method according to claim 10, wherein at least one first transducer is activated for ejecting a droplet, and at least one second transducer is kept silent and used only for measuring the change in electric response that is induced by the pressure wave created by the first transducer.

17. The method according to claim 10, further comprising the steps of:

energizing the transducer with an activation pulse that has a predetermined amplitude (Tp);

recording the change of electric response of that transducer as a function P(t) of time;

analyzing the function P(t) of time to decide whether or not a droplet has been expelled; and judging the obstruction status of the filter on the basis of the amplitude of the activation pulse and the result of the decision.

18. The method according to claim 10, wherein the jetting device is an ink jet print head and the method is performed while the print head is in a maintenance station.

19. The method according to claim 10, wherein the jetting device is an ink jet print head and the method is performed while the print head is operating, and wherein the demand for ink is created by printing on a recording medium.

* * * * *